US005613562A

United States Patent [19]

Galbraith et al.

[11] Patent Number: 5,613,562

[45] Date of Patent: Mar. 25, 1997

[54] APPARATUS FOR SUPPRESSING A FIRE

[75] Inventors: Lyle D. Galbraith, Redmond; Gary F. Holland, Snohomish; Donald R. Poole, Woodinville; Robert M. Mitchell, Issaquah, all of Wash.

[73] Assignee: Olin Aerospace Company, Redmond, Wash.

[21] Appl. No.: 704,214

[22] Filed: Aug. 28, 1996

Related U.S. Application Data

[60] Continuation of Ser. No. 460,364, Jun. 2, 1995, abandoned, which is a division of Ser. No. 248,932, May 25, 1994, Pat. No. 5,423,384, which is a continuation-in-part of Ser. No. 82,137, Jun. 24, 1993, Pat. No. 5,449,041.

[51] Int. Cl.[6] ..... A62C 5/00

[52] U.S. Cl. ..... 169/12; 169/26; 169/61; 169/62; 169/84; 149/61; 252/5; 252/7

[58] Field of Search ..... 149/19.6, 35, 36, 149/61, 77; 169/5, 6, 7, 8, 9, 11, 12, 26, 27, 28, 30, 35, 43, 44, 45, 46, 47, 60, 61, 62, 71, 72, 78, 84, 85; 252/2, 3, 4, 5, 6, 7

[56] References Cited

U.S. PATENT DOCUMENTS

| | | | |
|---|---|---|---|
| 798,142 | 8/1905 | Myers | 169/77 |
| 1,119,799 | 12/1914 | Bowman | 169/26 |
| 1,648,397 | 11/1927 | Hermann | 169/26 |
| 2,530,633 | 11/1950 | Scholz | 169/26 |
| 2,838,122 | 6/1958 | Hutchinson | 169/84 |
| 3,785,674 | 1/1974 | Poole et al. | 280/741 |
| 3,797,854 | 3/1974 | Poole et al. | 280/741 |
| 3,880,447 | 4/1975 | Thorn et al. | 280/740 |
| 3,901,747 | 8/1975 | Garner | 149/42 |
| 3,904,221 | 9/1975 | Shiki et al. | 280/736 |
| 3,924,688 | 12/1975 | Cooper et al. | 169/61 |
| 4,194,571 | 3/1980 | Monte | 169/61 |
| 4,274,491 | 6/1981 | Tarpley, Jr. | 169/46 |
| 4,276,938 | 7/1981 | Klimenko et al. | 169/47 |
| 4,319,640 | 3/1982 | Brobeil | 169/28 |
| 4,532,996 | 8/1985 | Wilson et al. | 169/23 |
| 4,601,344 | 7/1986 | Reed, Jr. et al. | 169/47 |
| 4,637,472 | 1/1987 | Decima | 169/35 |
| 4,889,189 | 12/1989 | Rozniecki | 169/73 |
| 4,915,853 | 4/1990 | Yamaguchi | 252/2 |
| 5,035,757 | 7/1991 | Poole | 149/46 |
| 5,284,706 | 2/1994 | O'Donnelly | 428/330 |
| 5,423,384 | 6/1995 | Galbraith et al. | 169/12 |

OTHER PUBLICATIONS

*The Journal of Fire & Flammability,* vol. 12 (Jul. 1981) ©1981 Technomic Publishing Co., Inc. "HF and HBr Production From Full Scale CF3Br(Halon 1301) Fire Suppression Tests" by Sheinson et al, appearing at pp. 229–235.

*The Journal of Fire & Flammability,* vol. 13 (Oct. 1982) ©1982 Technomic Publishing., Inc. "Fire Control in Aircraft 1 Comparative Testing of Some Dry Powder Chemical Fire Extinguishants and a New Effective System" by Ling et al, appearing at pp. 215–236.

*The New Encyclopedia Britannica* (Vol. 19) 15th Edition ©1986. "Five Prevention and Control" appearing at pp. 186–188.

*Scientific American* (Jun. 1993) vol. 268; No. 6. "Extingushed—A Champion Firefighter Goes Down for the Count" by W.W. Gibbs, appearing at p. 136.

*Primary Examiner*—Andrew C. Pike

*Attorney, Agent, or Firm*—Gregory S. Rosenblatt; Todd E. Garabedian

[57] ABSTRACT

There is disclosed an apparatus for suppressing a fire. The apparatus includes a gas generator containing as a propellant, a mixture of a fuel, strontium nitrate as an oxidizer, and magnesium carbonate. When the propellant is ignited, a nitrogen rich effluent is generated that is effective to suppress the fire. By providing the propellant with at least 35%, by weight, of magnesium carbonate, the generation of effluent by-products that are corrosive to aluminum is inhibited.

5 Claims, 5 Drawing Sheets

APPARATUS FOR SUPPRESSING A FIRE

CROSS REFERENCE TO RELATED APPLICATION

This patent application is a continuation of U.S. patent application Ser. No. 08/460,364 filed Jun. 2, 1995, now abandoned, which in turn is a division of U.S. patent application Ser. No. 08/248,932 filed May 25, 1994, now U.S. Pat. No. 5,423,384, which in turn is a continuation-in-part of U.S. patent application Ser. No. 08/082,137 entitled "Apparatus and Method for Suppressing a Fire" by Lyle D. Galbraith filed Jun. 24, 1993, now U.S. Pat. No. 5,449,041.

BACKGROUND OF THE INVENTION

This invention relates to an apparatus and a method for suppressing a fire. More particularly, a gas generator produces an elevated temperature first gas which interacts with a vaporizable liquid to generate a second gas having flame suppressing capabilities.

Fire involves a chemical reaction between oxygen and a fuel which is raised to its ignition temperature by heat. Fire suppression systems operate by any one or a combination of the following: (i) removing oxygen, (ii) reducing the system temperature, (iii) separating the fuel from oxygen, and (iv) interrupting the chemical reactions of combustion. Typical fire suppression agents include water, carbon dioxide, dry chemicals, and the group of halocarbons collectively known as Halons.

The vaporization of water to steam removes heat from the fire. Water is an electrical conductor and its use around electrical devices is hazardous. However, in non-electrical situations, when provided as a fine mist over a large area, water is an effective, environmentally friendly, fire suppression agent.

Carbon dioxide ($CO_2$) gas suppresses a fire by a combination of the displacement of oxygen and absorption of heat. Carbon dioxide gas does not conduct electricity and may safely be used around electrical devices. The carbon dioxide can be stored as compressed gas, but requires high pressure cylinders for room temperature storage. The cylinders are heavy and the volume of compressed gas limited. Larger quantities of carbon dioxide are stored more economically as a liquid which vaporizes when exposed to room temperature and atmospheric pressure.

When exposed to room temperature and atmospheric pressure, the expansion characteristics of liquid $CO_2$ are such that approximately one third of the vessel charge freezes during the blow down process. Only about two thirds of the $CO_2$ is exhausted in a reasonable time. The remainder forms a dry ice mass which remains in the storage vessel. While the dry ice eventually sublimes and exits the vessel, the sublimation period is measured in hours and is of little use in fire suppression.

The problem with liquid carbon dioxide based fire suppression systems is worse when low temperature operation is required. At −65° F., the vapor pressure of carbon dioxide is about 0.48 MPa (70 psig) (compared to 4.8 MPa (700 psig) at 70° F.) which is totally inadequate for rapid expulsion. The vessel freeze-up problem is worse. About 50% of the liquid carbon dioxide solidifies when exposed to −65° F. and atmospheric pressure.

Improved carbon dioxide suppression systems add pressurized nitrogen to facilitate the rapid expulsion of carbon dioxide gas at room temperature. The pressurized nitrogen does not resolve the freezing problem at low temperatures and at upper service extremes, about 160° F., the storage pressure is extremely high, dictating the use of thick, heavy, walled storage vessels.

Chemical systems extinguish a fire by separating the fuel from oxygen. Typical dry chemical systems include sodium bicarbonate, potassium bicarbonate, ammonium phosphate, and potassium chloride. Granular graphite with organic phosphate added to improve effectiveness, known as G-1 powder, is widely used on metal fires. Other suitable dry compounds include sodium chloride with tri-calcium phosphate added to improve flow and metal stearates for water repellency, dry sand, talc, asbestos powder, powdered limestone, graphite powder, and sodium carbonate. Dry chemical systems are delivered to a fire combined with a pressurized inert gas or manually such as with a shovel. The distribution system is inefficient for large fires and a significant amount of time is required to deliver an effective quantity of the dry powder to suppress a large fire.

The most efficient fire suppression agents are Halons. Halons are a class of brominated fluorocarbons and are derived from saturated hydrocarbons, such as methane or ethane, with their hydrogen atoms replaced with atoms of the halogen elements bromine, chlorine, and/or fluorine. This substitution changes the molecule from a flammable substance to a fire extinguishing agent. Fluorine increases inertness and stability, while bromine increases fire extinguishing effectiveness. The most widely used Halon is Halon 1301, $CF_3Br$, trifluorobromomethane. Halon 1301 extinguishes a fire in concentrations far below the concentrations required for carbon dioxide or nitrogen gas. Typically, a Halon 1301 concentration above about 3.3% by volume will extinguish a fire.

Halon fire suppression occurs through a combination of effects, including decreasing the available oxygen, isolation of fuel from atmospheric oxygen, cooling, and chemical interruption of the combustion reactions. The superior fire suppression efficiency of Halon 1301 is due to its ability to terminate the runaway reaction associated with combustion. The termination step is catalytic for Halon 1301 due to the stability of bromine radicals (Br•) formed when Halon 1301 is disposed on a combustion source.

When unreacted Halon 1301 migrates into the stratosphere, sunlight breaks down the Halon 1301 forming bromine radicals. Br• then reacts to consume ozone in an irreversible manner.

$$Br\bullet + O_3 \rightarrow BrO\bullet + O_2$$

In view of the current recognition that ozone depletion is a serious environmental problem, a move is on to identify: (i) fire suppression agents having a less severe environmental impact than Halon and (ii) devices to deliver these more environmentally friendly agents.

SUMMARY OF THE INVENTION

Accordingly, it is an object of the invention to provide a fire suppression apparatus for effectively delivering a fire suppressant which is less environmentally hazardous than Halon. It is a feature of the invention that the apparatus effectively delivers both liquid and solid fire suppressants. It is an advantage of the invention that the apparatus does not require significantly more space than Halon fire suppression apparatus. A further advantage of the invention is that both high and low vapor pressure liquids are effectively stored, vaporized, and delivered in gaseous form.

In accordance with the invention, there is provided an apparatus for suppressing a fire. The apparatus contains a gas generator and a vaporizable liquid contained within a chamber. A passageway is provided between the chamber and a fire. When activated, the apparatus suppresses a fire by generating an elevated temperature first gas. A first liquid is substantially vaporized by interaction with the first gas generating a second gas having flame suppressing capabilities, and the second gas is then directed at the fire.

In another embodiment of the invention, the first gas is an effective flame suppressant such as $CO_2$, $N_2$, or water vapor. The first gas may be used directly as a flame suppressant or combined with the second gas for flame suppression.

The above stated objects, features, and advantages will become more apparent from the specification and drawings which follow.

DETAILED DESCRIPTION OF THE DRAWINGS

Figure 1:
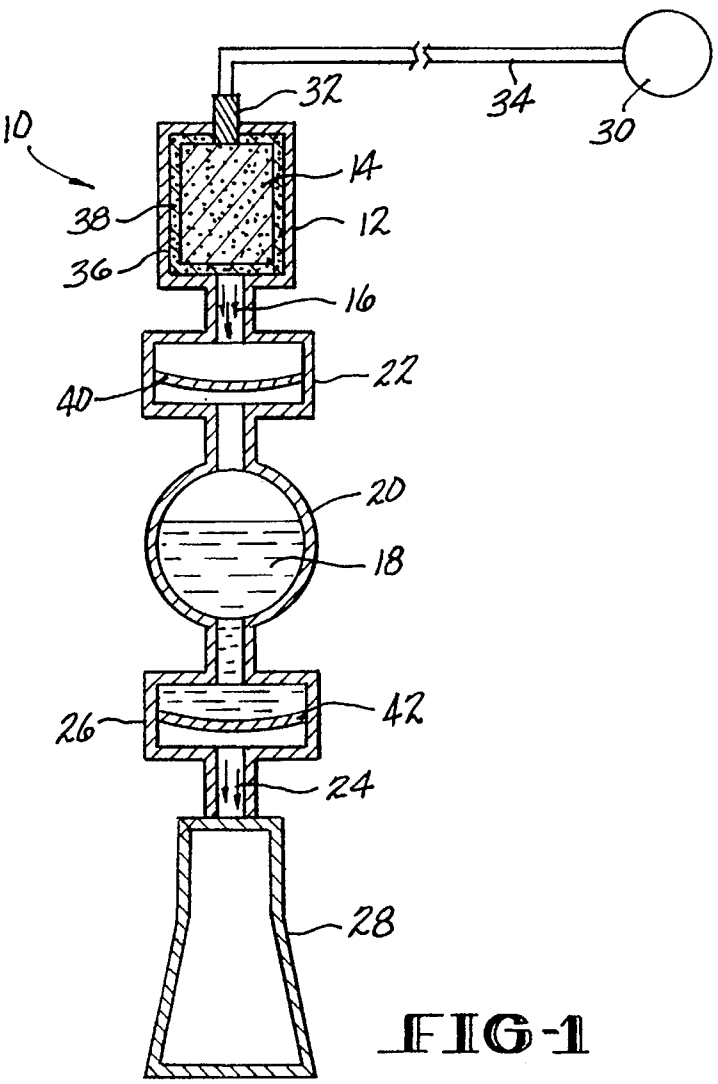
FIG. 1 illustrates in cross-sectional representation an apparatus for vaporizing a liquid to a flame suppressing gas in accordance with a first embodiment of the invention.

FIG. 1 shows in cross-sectional representation a fire suppression apparatus 10 in accordance with a first embodiment of the invention. A gas generator 12 containing a suitable solid propellant 14 delivers an elevated temperature first gas 16 to a vaporizable liquid 18 contained in a chamber 20. A first conduit 22 provides a passageway between the gas generator 12 and the chamber 20. The first gas 16 interacts with the vaporizable liquid 18 converting the liquid to a second gas 24. By proper selection of the vaporizable liquid 18, the second gas has flame suppressing capabilities. A second conduit 26 directs the second gas 24 to a fire. An optional aspirator 28 uniformly distributes the second gas 24 over a wide area.

The fire suppression apparatus 10 is permanently mounted in a ceiling or wall of a building, aircraft, or other suitable structure or vehicle. A sensor 30 detects the presence of a fire. Typically, the sensor 30 detects a rise in temperature or a change in the ionization potential of air due to the presence of smoke. On detecting a fire, the sensor 30 transmits an activating signal to a triggering mechanism 32. The activating signal may be a radio pulse, electric pulse transmitted by wires 34, or other suitable means.

The triggering mechanism 32 is any device capable of igniting the solid propellant 14. One triggering mechanism is an electric squib. The electric squib has two leads interconnected by a bridge wire, typically 0.076 mm–0.10 mm (3–4 mil) diameter nichrome. When a current passes through the leads, the bridge wire becomes red hot, igniting an adjacent squib mixture, typically, zirconium and potassium perchlorate. The ignited squib mixture then ignites an adjacent black powder charge, creating a fireball and pressure shock wave which ignites the solid propellant 14 housed within the gas generator 12.

The gas generator 12 contains a solid propellant 14 which on ignition generates a large volume of a high temperature gas containing fire suppressing fluids such as carbon dioxide, nitrogen, and water vapor. Depending on the selection of the vaporizable liquid and the type of fire anticipated as requiring suppression, the gas is generated for a period of time ranging from a few milliseconds to several seconds. One particularly suitable gas generator is the type used in automotive air bags. This type of gas generator is described in U.S. Pat. No. 3,904,221 to Shiki et al., which is incorporated by reference in its entirety herein. A housing 36 supports the solid propellant 14 and directs an explosive shock wave in the direction of the vaporizable liquid 18. Typical materials for the housing 36 include aluminum alloys and stainless steel.

The preferred solid propellant 14 is a combustible mixture which generates a copious amount of high temperature gas. The chemical reactions converting the propellant to the first gas generally do not occur efficiently at temperatures below about 1093° C. (2000° F.). The gas yield in moles per 100 grams of propellant should be in excess of about 1.5 moles and preferably in excess of about 2.0 moles. The propellants are generally a mixture of a nitrogen rich fuel and an oxidizing agent in the proper stoichiometric ratio to minimize the formation of hydrogen and oxygen. The preferred fuels are guanidine compounds, azide compounds and azole compounds.

Two preferred solid propellants are "RRC-3110" and "FS-01" (both available from Olin Aerospace Company of Redmond, Wash.). The compositions (in weight percent) of these propellants are:

| RRC-3110 | |
|---|---|
| 5-Aminotetrazole | 28.62% |
| Strontium nitrate | 57.38% |
| Clay | 8.00% |
| Potassium 5-Aminotetrazole | 6.00% |

When ignited, RRC-3110 generates $H_2O$, $N_2$, and $CO_2$ as well as SrO, $SrCO_3$, and $K_2CO_3$ particulate.

| FS-01 | |
|---|---|
| 5-Aminotetrazole | 29.20% |
| Strontium nitrate | 50.80% |
| Magnesium carbonate | 20.00% |

When ignited, FS-01 generates $H_2O$, $N_2$, and $CO_2$ as well as SrO, $SrCO_3$, and MgO particulate.

| Another useful propellant composition is: | |
|---|---|
| Guanidine nitrate | 49.50% |
| Strontium nitrate | 48.50% |
| Carbon | 2.00% |

When ignited, this composition releases a mixture of $H_2O$, $N_2$, and $CO_2$ gases along with SrO and $SrCO_3$ particulate solids.

Propellants which generate KCl salt are also suitable. KCl is effective in suppressing fires, but the corrosive nature of the salt limits the application of these propellants. Two such propellants are:

| | |
|---|---|
| 5-Aminotetrazole | 30.90% |
| Potassium perchlorate | 44.10% |
| Magnesium carbonate | 25.00% |

When ignited, this propellant generates $H_2O$, $N_2$, and $CO_2$ gas as well as KCl and MgO particulate.

| | |
|---|---|
| Potassium chlorate | 61.0% |
| Carbon | 9.0% |
| Magnesium carbonate | 30.0% |

When ignited, this propellant generates $CO_2$ as the only gas and KCl and MgO particulate.

Another suitable propellant generates nitrogen gas and solid slag which remains in the housing 36, and only the gas is delivered to the vaporizable liquid eliminating contamination of the area by the solid particulate.

| | |
|---|---|
| Sodium azide | 59.1% |
| Iron oxide | 39.4% |
| Potassium nitrate | 1.0% |
| Carbon | 0.5% |

When ignited, this propellant generates $N_2$ gas and slag which is not discharged from the housing.

The propellants useful in the apparatus of the invention are not limited to the five specified above. Any solid propellant capable of generating similar gaseous products at high velocity and high temperature is suitable.

The most preferred propellants contain magnesium carbonate as a suppressing agent. The magnesium carbonate may be combined with a fuel, as in the FS-01 propellant, combined with other suppressing agents, or utilized as a single component fire suppressing propellant. The magnesium carbonate endothermically decomposes to carbon dioxide (a good oxygen displacer) and magnesium oxide (a good heat sink and coolant).

Suitable propellants contain from that amount effective to extinguish a fire up to about 95% by weight magnesium carbonate and the balance being the mixture of a fuel and an oxidizer. Preferably, the propellant contains from about 20% to about 70% by weight magnesium carbonate and most preferably from about 30% to about 60% by weight magnesium carbonate.

Figure 5:
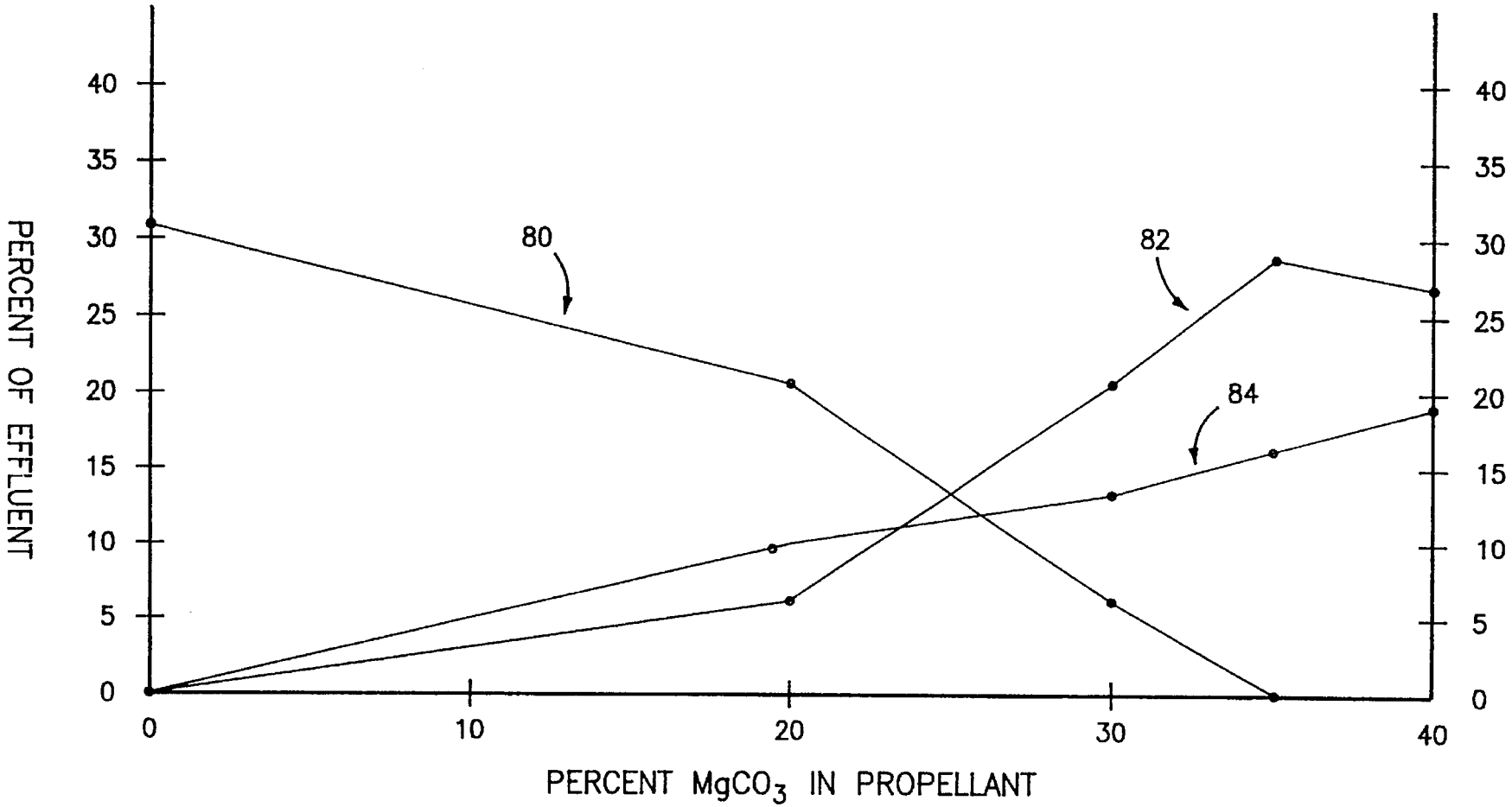
FIG. 5 graphically illustrates increasing the magnesium carbonate content in the gas generator reduces the formation of corrosive effluent.

When the magnesium carbonate content is low, propellants containing strontium nitrate yield effluent rich in strontium oxide. On exposure to atmospheric moisture, this yields extremely basic solutions that are corrosive to aluminum and other materials utilized in aircraft manufacture. With reference to FIG. 5, the inventors have determined a minimum magnesium carbonate content of about 35% is desired to minimize the corrosion potential.

Propellant additives such as magnesium carbonate act as endothermic heat sinks and carbon dioxide generators. These effects decrease the corrosivity of propellant effluent by minimizing the amount of strontium oxide generated. FIG. 5 graphically illustrates the composition of the gaseous effluent generated by igniting the FS-01 fuel with varying amounts of magnesium carbonate present. The strontium oxide content is identified by reference line 80. Approximately 35 weight percent magnesium carbonate is required to achieve an essentially strontium oxide-free effluent.

Strontium carbonate (reference line 82) and magnesium oxide (reference line 84) form compounds with a pH near 7 when exposed to atmospheric moisture and generally do not cause significant corrosion.

A preferred propellant contains a nitrogen rich fuel, an oxidizer, and magnesium carbonate. Suitable propellants include modifications of FS-01 containing 5-aminotetrazole and an oxidizer, such as strontium nitrate, potassium perchlorate, or mixtures thereof. The fuel to oxidizer ratio, by weight, is from about 1:1 to about 1:2. Combined with the fuel and oxidizer is from about 20% to about 70% by weight magnesium carbonate (measured as a percentage of the propellant/magnesium carbonate/additives compacted mixture). The propellant may also contain additives such as clay (to improve molding characteristics) or graphite (to improve flow characteristics).

The propellant is a mixture of compacted powders. If all powder components are approximately the same size, the burn rate is unacceptably low. Preferably, the propellant is a mixture of relatively large magnesium carbonate particles having an average particle diameter of from about 150 microns to about 200 microns and relatively small fuel and oxidizer particles having an average particle diameter of from about 50 microns to about 75 microns. The larger magnesium carbonate particles form discrete coolant sites and do not reduce the propellant burn rate as drastically as when all components are approximately the same size.

The solid propellant may be required to generate the gas over a time ranging from about 30 milliseconds to several seconds. Typically, a short "burn time" is required in an explosive environment while a longer burn time is required in a burning environment. If a short burn time is desired, the propellant is in the form of tablets, typically on the order of 1 centimeter in diameter by about one-half centimeter thick. Increasing the pellet size increases the burn time. For a burn time of several seconds, the gas generator contains a single propellant slug compression molded into the housing.

Referring back to FIG. 1, to prevent the housing 36 from melting during ignition of the solid propellant 14, a cooling material 38 may be disposed between the housing 36 and solid propellant 14. One cooling material is granular magnesium carbonate which generates carbon dioxide when heated above 150° C. (300° F.). One mole of $MgCO_3$ will produce one mole of $CO_2$ plus one mole of MgO, which remains in the housing 36 in the form of a slag. Small amounts of MgO dust may be exhausted during ignition of the solid propellant.

To prevent contamination of the chamber 20 by the solid propellant 14 prior to ignition, a first rupture diaphragm 40 isolates the vaporizable liquid 18. The isolation diaphragm 40 is ruptured by the pressure of the shock wave. No active device such as a disk rupturing detonator is required. To prevent the generation of mechanical debris, the isolation diaphragm 40 may have score lines and hinge areas to open in a petal like fashion.

The first conduit 22 forms a passageway to communicate the first gas 16 to the vaporizable liquid 18. The first gas 16 is superheated and traveling at high velocity. Interaction of the first gas and the vaporizable liquid 18 vaporizes the liquid, generating a second gas 24. The second gas 24 ruptures the second isolation diaphragm 42 and is expelled as a fire suppressing gas, preferably through aspirator 28.

The selection of the vaporizable liquid 18 is based on a desire that the second gas 24 be less reactive with atmospheric ozone than Halon. The vaporizable liquid 18 contains no bromine, and preferably also no chlorine. Preferred groups of vaporizable liquids 18 include fluorocarbons, molecules containing only a carbon-fluorine bond, and hydrogenated fluorocarbons, molecules containing both carbon-hydrogen and carbon-fluorine bonds. Table 1 identifies preferred fluorocarbons and hydrogenated fluorocarbons and their vaporization temperatures. For comparison, the data for Halon 1301 is also provided.

TABLE 1

| System | Formula | Vaporization Temperature (°C.) | Vaporization Pressure Room Temperature (psi) |
|---|---|---|---|
| HFC-32 | $CH_2F_2$ | −52 | 120 |
| HFC-227 | $CF_3CHFCH_3$ | −15 | 59 |
| HCFC-22 | $CHClF_2$ | −41 | 139 |
| HCFC-134A | $CF_3CH_2F$ | −27 | 83 |
| FC-116 | $CF_3CF_3$ | −78 | 465 |
| HCFC-124 | $CHClFCF_3$ | −12 | 61 |
| HFC-125 | $CF_3CF_2H$ | −48 | 195 |
| FC-31-10 | $C_4F_{10}$ | −2 | — |
| FC-C318 | $(CF_2)_4$ | −4 | — |
| HF-23 | $CF_3H$ | −82 | 700 |
| HCFC-123 | $CF_3CCl_2H$ | −28 | 13 |
| FC-218 | $CF_3CF_2CF_3$ | −36 | 120 |
| FC-614 | $C_6F_{14}$ | +56 | — |
| HALON 1301 | $CF_3Br$ | −58 | 220 |

The most preferred fluorocarbons and hydrogenated fluorocarbons are those with the higher boiling points and lower vapor pressures. The higher boiling point reduces the pressure required to store the vaporizable liquid 18 as a liquid. The lower vapor pressures increase the rate of conversion of the vaporizable liquid to fire suppressing gas on ignition. Particularly suitable are HFC-227, FC-31-10, FC-C318, and FC-218.

Unsaturated or alkene halocarbons have a low vapor pressure and a relatively high boiling point. These unsaturated molecules contain a carbon-carbon double bond, together with a carbon-fluorine bond, and in some cases, a carbon-hydrogen bond. The unsaturation causes these compounds to be considerably more photosensitive than a saturated species, leading to significant photochemical degradation in the lower atmosphere. The low altitude photodegradation may lessen the contribution of these compounds to stratospheric ozone depletion. Through the use of an unsaturated halocarbon in the fire suppression apparatus of the invention, it is possible that bromine containing compounds may be tolerated.

Representative haloalkenes have a boiling point of from about 35° C. to about 100° C. and include 3-bromo-3,3-difluoro-propene, 3-bromo-1,1,3,3,tetrafluoropropene, 1-bromo-3,3,3-trifluoro-1-propene, 4-bromo-3,3,4,4,tetrafluoro-1-butene, and 4-bromo-3,4,4-trifluoro-3-(trifluormethyl)-1-butene, as well as homologues, analogs, and related compounds.

One disadvantage with the fluorocarbons and hydrogenated fluorocarbons, whether saturated or unsaturated, is the generation of small amounts of hydrogen fluoride when the vapor contacts a fire. Hydrogen fluoride is corrosive to equipment and hazardous to personnel.

The significant heat and pressure conducted by the first gas 16 permits the use of liquid carbon dioxide or water as the vaporizable liquid 18. The expansion problem identified above for nonenergetically discharged liquid carbon dioxide is eliminated by the superheating effect of the first gas 16. Water is converted to a fine mist of steam on interaction with the first gas and is highly effective for flame suppression.

As water is such an effective fire suppression media when delivered in the form of fine droplets, a mist, or as a superheated steam to a fire, it is one of the most favored fluids for use in this gas generation concept. However, because water freezes at a temperature of 0° C. (32° F.), a means must be incorporated to either suppress the freezing point or the design of the gas generator must be such that it can operate effectively with the water frozen solid.

Most military and commercial applications require that fire suppression equipment operate effectively over a temperature range of −54° C. to +71° C. (−65° F. to +160° F.). Many additives such as ammonia, alcohol, glycols, and salts are capable of suppressing the water freezing point to below −54° C. (−65° F.), but a considerable portion of the mixture becomes the additive. Most additives are flammable or corrosive, degrading the effectiveness and desirable features of a water system when freezing point depressants are present in the water.

To maintain the desirable features of water as the agent for the gas generator driven system, the system can be designed to operate effectively over the desired −54° C. to +71° C. (−65° F. to +160° F.) temperature range even if the water has frozen solid.

Figure 6:
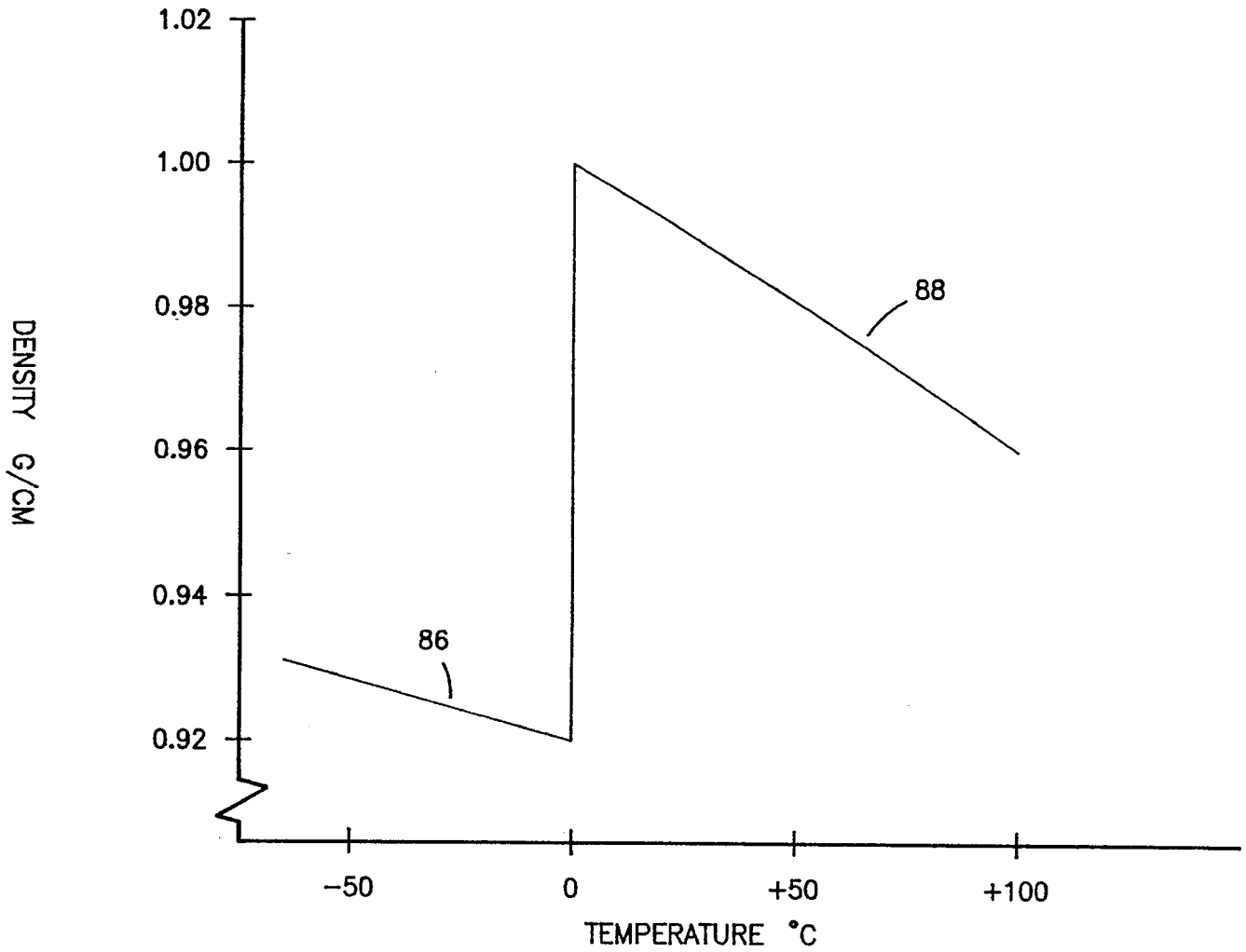
FIG. 6 graphically illustrates the relationship between pressure and density for ice and water.

FIG. 6 graphically illustrates the relationship between density and temperature for water and ice at atmospheric pressure, moderate increased pressure, and moderate vacuums. At slightly over 0° C. (+32° F.), the density of liquid water is 1.0 g/cm$^3$ (62.40 lbm/ft$^3$). If the temperature of the water is reduced just below 0° C. (32° F.), the water will freeze to ice and expand considerably in volume. The density of ice at 0° C. (+32° F.) is 0.92 g/cm$^3$ (357.50 lbm/ft$^3$).

Below 0° C., the density of ice increases as the temperature is decreased as illustrated by reference line 86. Above 0° C., the density of water decreases as the temperature is increased as illustrated by reference line 88.

Figure 7:
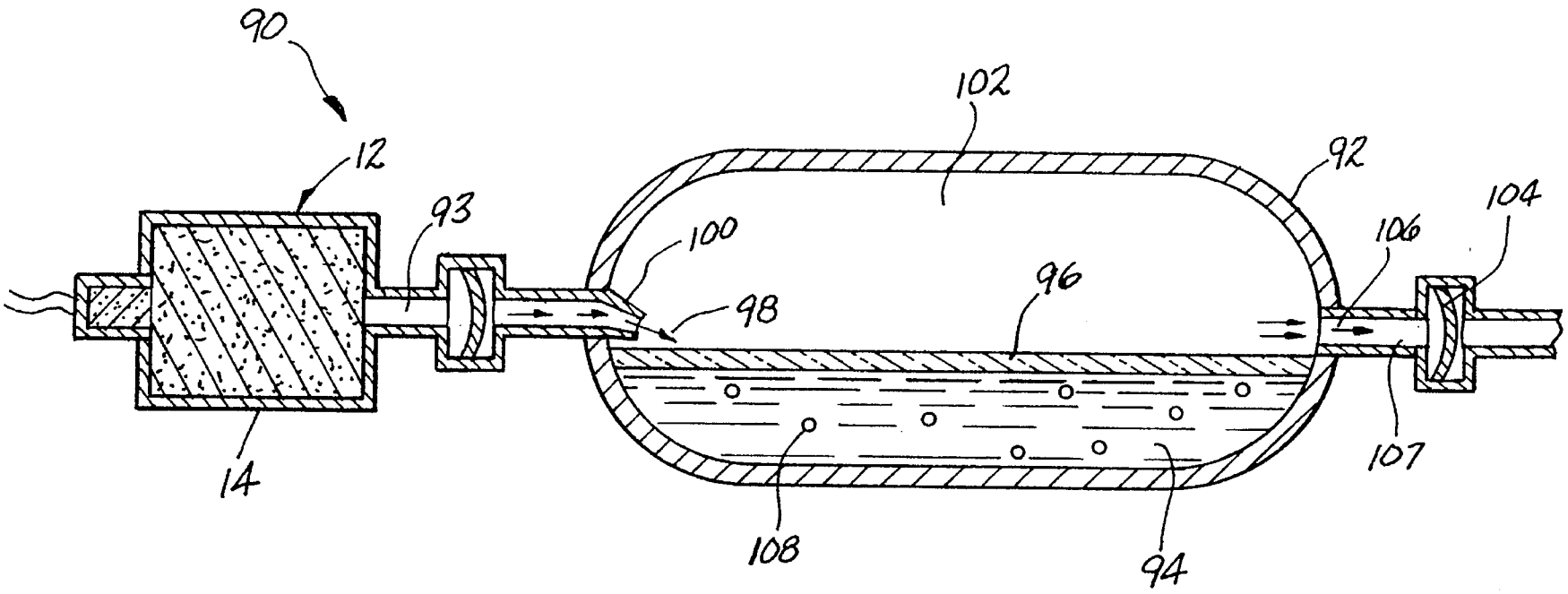
FIG. 7 illustrates in cross-sectional representation a water based fire suppression system in accordance with the invention.

FIG. 7 shows in cross-sectional representation a water-based fire suppression system 90 that accommodates the expansion of ice due to freezing of the water. The fire suppression system 90 includes a solid propellant gas generator 12 described above and previously illustrated in FIG. 1. The gas generator 12 communicates with a tank 92 by a passageway formed by a first conduit 93. The tank 92 contains a mixture of water 94 and ice 96. The tank 92 has a volume larger than the volume of ice that would be contained if all the water 94 was frozen.

The gas generator 12 provides sufficient thermal energy to heat the ice 96 to the freezing point and melt the ice by directing a hot gas 98 produced by the gas generator 12 in the direction of the ice 96. Nozzle 100 may be provided to direct the flow of the hot gas 98 to impinge the mixture of ice and water inducing turbulence to assure good mixing and vaporization of the water.

Heating of the ice 96 and water 94 is further enhanced by the use of a propellant which exhausts a significant percent of solids into the tank 92 along with the hot gases 98. Preferably, at least about 20% by weight, and most preferably, at least about 40% by weight of the effluent is solid particles.

The tank 92 is designed to facilitate unrestricted expansion of ice 96. There are no pockets or cavities to interfere with the ice growth. Mechanical parts of the gas generator are not in the path of ice growth to minimize breaking of the mechanical parts.

The temperature of the generated gases is preferably in excess of about 925° C. (1700° F.) an typically exceeds 1093° C. (2000° F.). The gas generator is preferably selected so that the exhaust contains at least 20% and preferably in excess of about 40% by weight hot solid particulate (i.e. MgO, etc.). This exhaust stream provides a very effective means for rapidly melting the ice.

Another feature of the water-based fire suppression system 90 is that the ullage space 102 above the water 94 and ice 96 is sufficiently large to assure that the resulting pressure of the hot gases 98 exhausting into the tank 92 do not produce a pressure sufficient to rupture the outlet burst disc 104, typically about 13.8 MPa (2000 psig). The system is designed to require additional hot gases 98 from the gas generator 92 to be added to superheat the vaporized water before the outlet disc 104 is ruptured and flow commences.

Once the outlet disc 104 has been ruptured, the continuing flow of gases 98 from the gas generator 12 creates significant turbulence and mixing of the water 94 within the tank 92 vaporizing the water to produce steam 106. Depending upon the particular fire suppressing application, it may be desirable to design the unit to produce low quality steam at low temperatures or superheated steam at higher temperatures. Any temperature and steam quality can be produced by the proper proportioning of the water and solid propellant used in the system. The steam 106 is directed at the fire through a second passageway formed by a second conduit 107.

It is sometimes desirable to incorporate an additive 108 to the water 94 to reduce the heat of fusion of the ice 96. Effective chemical additives include polyvinyl alcohol and water soluble polymers such as methyl cellulose, added to the water in concentrations of less than about 15% by volume. The additives 108 also tend to form a viscous gel when properly added to the water. This higher viscosity working fluid is much less prone to leaking from the tank 92 than water.

Figure 2:
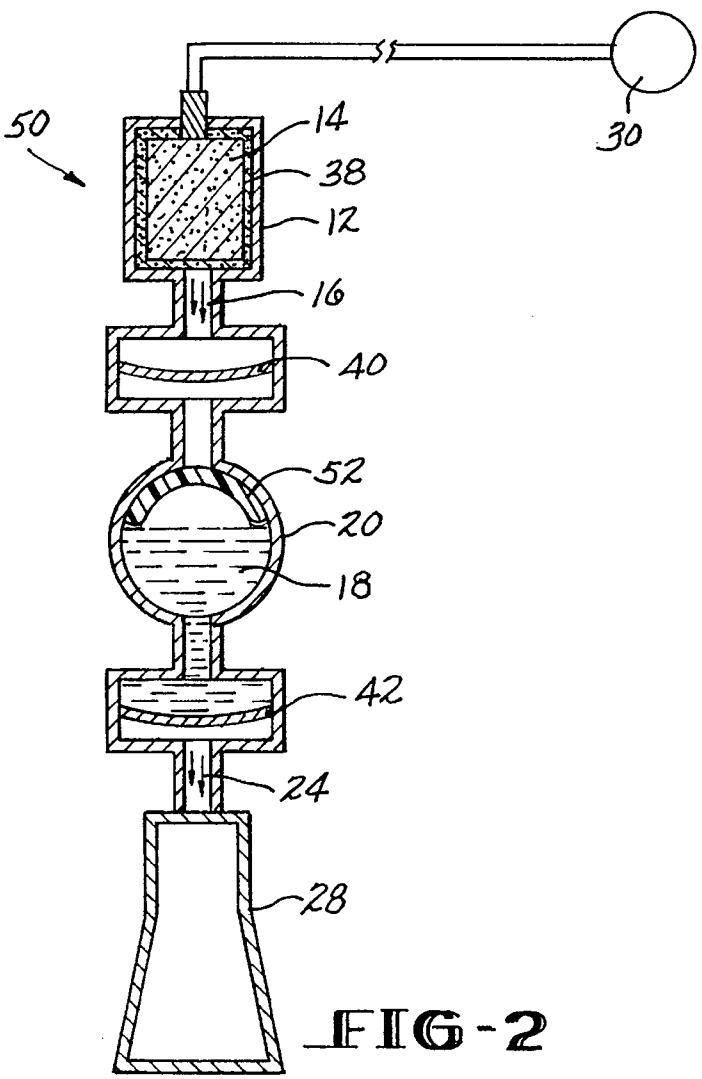
FIG. 2 illustrates in cross-sectional representation an apparatus for vaporizing a liquid to a flame suppressing gas in accordance with a second embodiment of the invention.

In a second embodiment of the invention, the fire suppression apparatus 50 is as illustrated in cross-sectional representation in FIG. 2. The elements of the second fire suppression apparatus 50 are substantially the same as those illustrated in FIG. 1 and like elements are identified by like Figure numerals. Typically the solid propellant 14 generates solid particulate along with the first gas. Particulate may be also be generated by other components of the fire suppression apparatus such as the magnesium carbonate cooling layer 38. If the environment in which the flame suppression apparatus 50 is located would be detrimentally effected by the presence of solid particulate, a bladder 52 may be disposed between the gas generator 12 and the chamber 20. The energetic first gas 16 forcedly deforms the flexible bladder 52, generating a shock wave vaporizing the vaporizable liquid 18 and generating the second gas 24. The bladder 52 may be any suitable material such as a high temperature elastomer.

This second embodiment does not superheat the vaporizable liquid 18 as effectively as the first embodiment. The transfer of heat through the elastomeric material 52 is limited. Accordingly, lower boiling point vaporizable liquids such as HFC-32, FC-116, and HF-23 are preferred.

Figure 3:
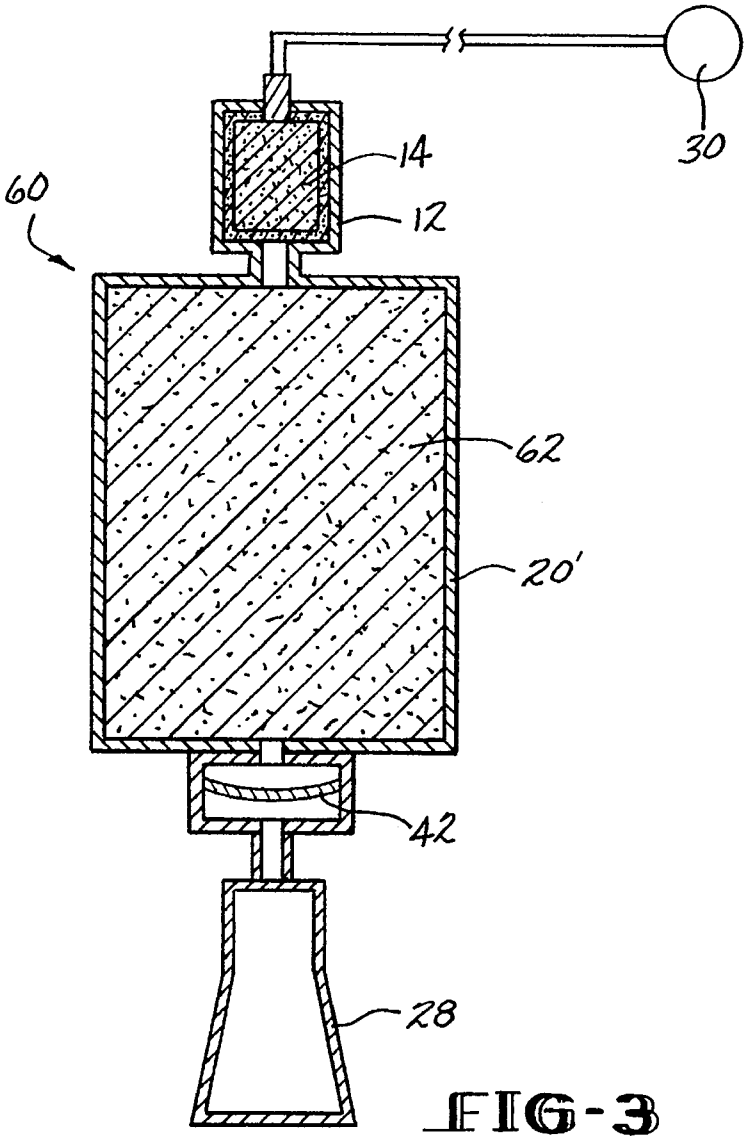
FIG. 3 illustrates in cross-sectional representation an apparatus for delivering a dry chemical flame suppressant to a fire.

In a third embodiment of the invention, a solid flame suppressant may be utilized as illustrated by the flame suppression apparatus 60 of FIG. 3. The flame suppression apparatus 60 illustrated in cross-sectional representation is similar to the earlier embodiments and like elements are identified by like reference numerals, while elements performing a similar function are identified by primed reference numerals. The chamber 20' is packed with small diameter, on the-order of from about 5 to about 100 micron, and preferably from about 10 to about 50 micron, particles 62 of any effective flame suppressing material. Suitable materials include potassium bicarbonate, sodium bicarbonate, ammonium phosphate, potassium chloride, granular graphite, sodium chloride, magnesium hydroxide, calcium hydroxide, strontium hydroxide, barium hydroxide, aluminum hydroxide, magnesium carbonate, potassium sulfate, sand, talc, powdered limestone, graphite powder, sodium carbonate, strontium carbonate, calcium carbonate, and magnesium carbonate. These and other suitable materials may be mixed with boron oxide as disclosed in U.S. Pat. No. 4,915,853 to Yamaguchi.

Figure 4:
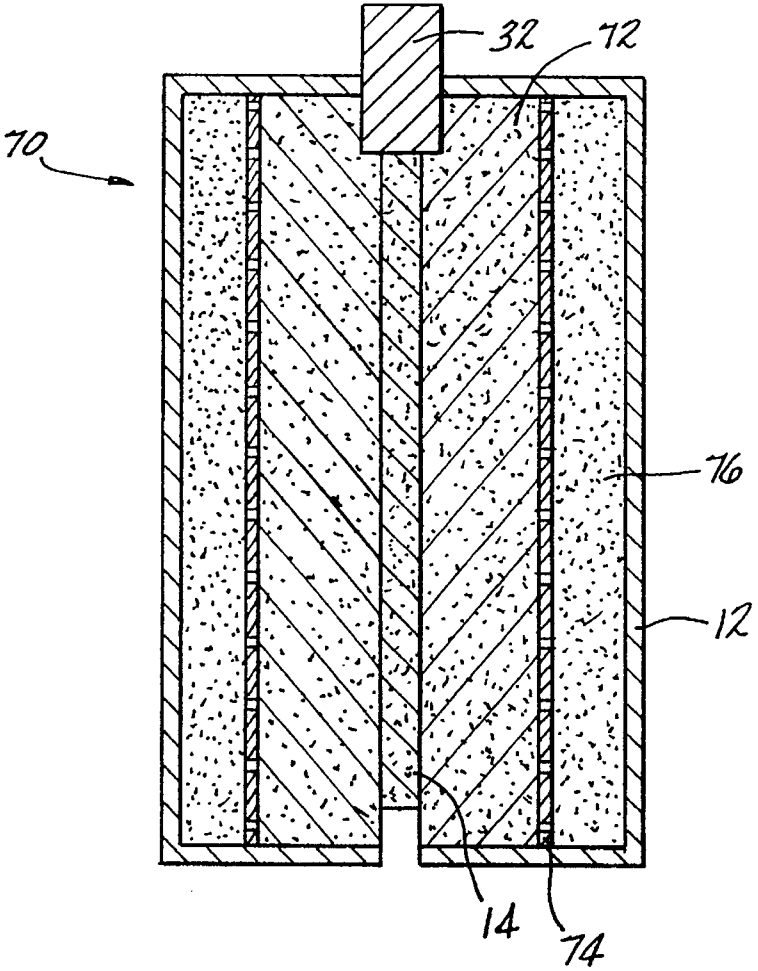
FIG. 4 illustrates in cross-sectional representation a carbon dioxide producing gas generator.

In the preceding embodiments of the invention, the flame suppression apparatus has been described in terms of a superheated gas interacting with a vaporizable liquid. The superheated gas is predominantly nitrogen, carbon dioxide, and water vapor, all effective fire suppressants. In certain applications, it is preferred to omit the vaporizable liquid and discharge the flame suppressing gases generated by the solid propellant directly onto the fire. A carbon dioxide producing gas generator 70 is illustrated in cross-sectional representation in FIG. 4.

The carbon dioxide producing gas generator 70 is similar to the gas generators described above. An electric squib 32 activates an energetic mixture of a solid propellant 14. On ignition, the solid propellant 14 ignites a magnesium carbonate containing propellant 72 generating MgO, $CO_2$, $N_2$, and water vapor. A perforated screen 74 separates the propellants from the housing 12. A magnesium carbonate cooling bed 76 is disposed between the housing 12 and propellants and the on heating generates additional $CO_2$. The propellant 72 may contain other fire suppressing agents, in addition to magnesium carbonate, either alone or in combination. Suitable fire suppressing agents include magnesium hydroxide, calcium hydroxide, strontium hydroxide, barium hydroxide, and aluminum hydroxide.

The following examples illustrate the effectiveness of the flame suppressing apparatus of the invention.

EXAMPLES

EXAMPLE 1

The gas generator 70 is an efficient apparatus for delivering a low molecular weight inerting agent, such as $CO_2$, $N_2$, or water vapor, to a fire. The weight of the apparatus and propellant compares favorably to the weight of a halon based fire suppression system.

Gas Generator Characteristics

Length—42.24 centimeters (16.63 inches)

Diameter—13.97 centimeters (5.50 inches)

Displaced external volume—0.0065 meter$^3$ (395 inch$^3$)

FS-01 propellant load—2.01 kilograms (4.437 pounds), generates 1.41 kilograms (3.10 pounds) of $CO_2$, $N_2$, and water vapor $MgCO_3$ coolant load—6.00 kilograms (13.21 pounds), generates 3.13 kilograms (6.894 pounds) of $CO_2$)

Total inerting gas produced—4.54 kilograms (10.00 pounds)

Estimated weight of total system—11.8 kilograms (26.10 pounds)

Gas Generator Materials

Housing 12—Aluminum alloy 6061-T6

Solid propellant 14—$BKNO_3$

FS-01 propellant 72—in pellet form, size of pellets based on desired burn time, about 1 centimeter diameter by 0.5 centimeter thick tablets provide a 30 millisecond burn.

$MgCO_3$ coolant bed 76—granular

Perforated retaining screen 74 has 1.27 millimeter (0.050 inch) perforations.

This system will produce about 4.54 kilograms (10 pounds) of $CO_2$, $N_2$, and water vapor, have a mass of about 11.8 kilograms (26.10 pounds) and occupy 0.0065 meter$^3$ (395 inch$^3$) of space. By comparison, a Halon 1301 system containing 4.54 kilograms (10 pounds) of fire suppressant has a mass of about 8.6 kilograms (19 pounds) and occupies 0.0065 meter$^3$ (365 inch$^3$) of space. While the system of the invention is only sightly larger and more massive than the Halon system, other Halon replacement systems are predicted to increase the mass by a factor of 2 or 3.

EXAMPLE 2

The corrosive action of saturated solutions of the effluent components on materials commonly utilized in aircraft was evaluated. An aqueous solution saturated with the effluent was prepared and the pH measured. Various materials were then exposed to a 50% relative humidity atmosphere of each saturated solution. After a 30 day exposure, the coupons were analyzed for corrosion pits. Table 2 illustrates the benefit of removing strontium oxide from the effluent.

The patents cited in this application are intended to be incorporated by reference.

It is apparent that there has been provided in accordance with this invention an apparatus and method for suppressing a fire which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the claims.

TABLE 2

| | Composition | | MgO | $SrCO_3$ | FS-01 40% $MgCO_3$ | FS-01 20% $MgCO_3$ | 3110 | SrO | KOH |
|---|---|---|---|---|---|---|---|---|---|
| pH (measured) Sat. Aq. Soln. | | | 8.5 | 9.0 | 9.0 | 11.0 | 11.5 | 13.5 | 13.5 |
| A06061 chromated surface | Mg | 0.8–1.2 | not analyzed | not analyzed | O | uniform pitting | uniform pitting | uniform pitting | uniform pitting |
| | Si | 0.4–0.8 | | | | | | | |
| | Cu | 0.15–0.40 | | | | | | | |
| | Cr | 0.04–0.34 | | | | | | | |
| | Al | Balance | | | | | | | |
| A07075 anodized surface | Zn | 5.1–6.1 | O | O | O | O | O | 3 | 3 |
| | Mg | 2.1–2.9 | | | | | | | |
| | Cu | 1.2–2.0 | | | | | | | |
| | Cr | 0.18–0.35 | | | | | | | |
| | Al | Balance | | | | | | | |
| A07050 anodized surface | Zn | 2.7–3.3 | O | O | O | 2 | 5 | uniform pitting | O |
| | Mg | 1.4–1.8 | | | | | | | |
| | Mn | 0.4–0.6 | | | | | | | |
| | Cr | 0.2–0.4 | | | | | | | |
| | Al | Balance | | | | | | | |
| Ti—6Al—4V bare surface | Al | 6 | O | O | O | O | O | O | O |
| | V | 4 | | | | | | | |
| | Ti | Balance | | | | | | | |
| A07075 bare surface | | | O | O | O | not analyzed | not analyzed | 10 | 50 |
| A07050 bare surface | | | O | O | O | not analyzed | not analyzed | 24 | 94 |
| Graphite/ Epoxy | | | O | O | O | O | O | O | O |
| Kevlar | Poly (p-phenylene-diamine-co-terephthalic) acid | | O | O | O | O | O | O | O |

We claim:

1. An apparatus for suppressing a fire, said apparatus comprising:

a gas generator containing a propellant that is a mixture of a fuel, strontium nitrate as an oxidizer, and magnesium carbonate, wherein the magnesium carbonate content of said propellant is at least 35% by weight that is sufficient to inhibit the generation of effluent by-products that are corrosive to aluminum; and a passageway between said gas generator and said fire.

2. The apparatus of claim 1 wherein a fire suppressant selected from the group consisting of magnesium hydroxide, calcium hydroxide, strontium hydroxide, barium hydroxide, aluminum hydroxide, and potassium hydroxide is mixed with said propellant.

3. The apparatus of claim 1 wherein said fuel is a nitrogen rich fuel and present in a fuel-to-oxidizer ratio, by weight, of from about 1:1 to about 1:2.

4. The apparatus of claim 3 wherein said fuel is 5-aminotetrazole.

5. The apparatus of claim 4 wherein said propellant contains from about 35% to about 70%, by weight, of said magnesium carbonate.

* * * * *